US008361341B2

(12) United States Patent
Ulicny et al.

(10) Patent No.: US 8,361,341 B2
(45) Date of Patent: Jan. 29, 2013

(54) MAGNETORHEOLOGICAL COMPOSITIONS INCLUDING NONMAGNETIC MATERIAL

(75) Inventors: John C. Ulicny, Oxford, MI (US); Mark A. Golden, Washington, MI (US); Keith S. Snavely, Sterling Heights, MI (US); Prabhakar Marur, Karnataka (IN)

(73) Assignee: GM Global Technology Operations LLC, Detroit, MI (US)

( * ) Notice: Subject to any disclaimer, the term of this patent is extended or adjusted under 35 U.S.C. 154(b) by 669 days.

(21) Appl. No.: 12/576,485

(22) Filed: Oct. 9, 2009

(65) Prior Publication Data

US 2010/0224820 A1 Sep. 9, 2010

Related U.S. Application Data

(60) Provisional application No. 61/158,502, filed on Mar. 9, 2009.

(51) Int. Cl.
*H01F 1/44* (2006.01)

(52) U.S. Cl. ..... 252/62.52; 252/62.55

(58) Field of Classification Search ..... 252/62.52
See application file for complete search history.

(56) References Cited

U.S. PATENT DOCUMENTS 5,354,488 A * 10/1994 Shtarkman et al. ..... 252/62.56
5,525,249 A 6/1996 Kordonsky et al.
5,804,095 A * 9/1998 Jacobs et al. ..... 252/62.52
6,149,832 A * 11/2000 Foister ..... 252/62.52
6,875,368 B2 4/2005 John et al.
7,306,083 B2 * 12/2007 Ulicny et al. ..... 192/21.5
2004/0140447 A1 7/2004 Kintz et al.
2007/0210274 A1 * 9/2007 Bose et al. ..... 252/62.51 R
2009/0173908 A1 7/2009 Bose et al.

OTHER PUBLICATIONS

Derwent Abstract for CN 101250380A, Aug. 27, 2008.*
I.G. Yanez-Flores, R. Betancourt-Galindo, J.A. Matutes Aquino, O.Rodriquez-Fernandez, "Preparation and characterization of magnetic PVC nanocomposites", Journal of Non-Crystalline Solids, 2007, 799-801, 353.
Ruben Saldivar-Guerrero, Reinhard Richter, Ingo Rehberg, Nuri Aksel, Lutz Heymann, Oliverio S. Rodrigues-Fernandez, "Solid to liquid transition of inverse ferrofluids under shear", Magnetohydrodynamics, 2005, 385-390, vol. 41 #4.

* cited by examiner

*Primary Examiner* — Carol M Koslow
(74) *Attorney, Agent, or Firm* — Quinn Law Group, PLLC

(57) ABSTRACT

A magnetorheological composition includes a mixture of a carrier medium and a particle component disposed in the carrier medium. The particle component includes a magnetic material and a nonmagnetic material. The nonmagnetic material is present in the particle component in an amount of from about 5 to about 95 parts by volume based on 100 parts by volume of the particle component. The particle component is present in the magnetorheological composition in an amount of from about 20 to about 80 parts by volume based on 100 parts by volume of the magnetorheological composition. The magnetorheological composition has an on-state yield stress at magnetic saturation of from about 0.1 to about 100 kPa.

17 Claims, 6 Drawing Sheets

MAGNETORHEOLOGICAL COMPOSITIONS INCLUDING NONMAGNETIC MATERIAL

CROSS-REFERENCE TO RELATED APPLICATIONS

This application claims the benefit of U.S. Provisional Patent Application No. 61/158,502, filed on Mar. 9, 2009, which is hereby incorporated by reference in its entirety.

TECHNICAL FIELD

The present invention generally relates to magnetorheological materials, and more specifically, to magnetorheological materials including nonmagnetic material.

BACKGROUND OF THE INVENTION

Magnetorheological compositions generally include a mixture of magnetic particles and a carrier medium. When a magnetorheological composition is subjected to a magnetic field, the viscosity of the magnetorheological composition generally increases substantially so that the magnetorheological composition may behave as a solid rather than a fluid. That is, when not subjected to the magnetic field, i.e., when "off-state", the magnetic particles may be distributed substantially homogeneously in the carrier medium. In contrast, when subjected to the magnetic field, i.e., when "on-state", the magnetic particles may align in chain-like structures disposed parallel to the magnetic field and perpendicular to the direction of flow. Therefore, flow may be impeded so that the magnetorheological composition behaves as a solid. Because of such magnetic and rheological properties, magnetorheological compositions may be useful for applications requiring energy absorption.

On-state yield stress at magnetic saturation, i.e., a value beyond which the magnetorheological composition begins to flow, may be increased by increasing a magnetic particle concentration in the magnetorheological composition. However, increased magnetic particle concentration generally increases the weight, and therefore the density and cost, of the magnetorheological composition.

Additionally, on-state yield stress at magnetic saturation may also be increased by increasing a saturation magnetization of the magnetic particles. However, magnetic particles having increased saturation magnetization are often unavailable in commercial quantities, thereby further increasing the cost of the magnetorheological composition.

SUMMARY OF THE INVENTION

A magnetorheological composition includes a mixture of a carrier medium and a particle component disposed in the carrier medium. The particle component includes a magnetic material and a nonmagnetic material. The nonmagnetic material is present in the particle component in an amount of from about 5 to about 95 parts by volume based on 100 parts by volume of the particle component. The particle component is present in the magnetorheological composition in an amount of from about 20 to about 80 parts by volume based on 100 parts by volume of the magnetorheological composition. The magnetorheological composition has an on-state yield stress at magnetic saturation of from about 0.1 to about 100 kPa.

In another embodiment, a magnetorheological composition includes a mixture of a polyalphaolefin and a particle component disposed in the polyalphaolefin. The particle component includes carbonyl iron powder and a nonmagnetic material. The nonmagnetic material is present in the particle component in an amount of from about 7 to about 45 parts by volume based on 100 parts by volume of the particle component. The particle component is present in the magnetorheological composition in an amount of from about 40 to about 55 parts by volume based on 100 parts by volume of the magnetorheological composition. The magnetorheological composition has an on-state yield stress at magnetic saturation of from about 0.1 to about 100 kPa.

In yet another embodiment, a magnetorheological composition includes a mixture of a polyalphaolefin and a particle component disposed in the polyalphaolefin. The particle component includes carbonyl iron powder and a nonmagnetic material having an average particle size of from about 9 to about 13 μm. The magnetic material is present in the particle component in an amount of from about 7 to about 45 parts by volume based on 100 parts by volume of the particle component. The particle component is present in the magnetorheological composition in an amount of about 45 parts by volume based on 100 parts by volume of the magnetorheological composition. The magnetorheological composition has an on-state yield stress at magnetic saturation of from about 0.1 to about 100 kPa.

The magnetorheological compositions exhibit excellent on-state yield stress at magnetic saturation. Further, the magnetorheological compositions include a lower concentration of magnetic material, and therefore have a lower weight and density as compared to existing magnetorheological compositions. Further, the magnetorheological compositions suffer from less particle-carrier medium separation and less particle settling without the use of a suspending agent as compared to existing magnetorheological compositions. As such, the magnetorheological compositions of the present invention are cost effective. Additionally, the magnetorheological compositions enable the development of magnetorheological devices having higher force capability for a given size, or an equivalent force capability for a smaller size, as compared to available magnetorheological devices.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
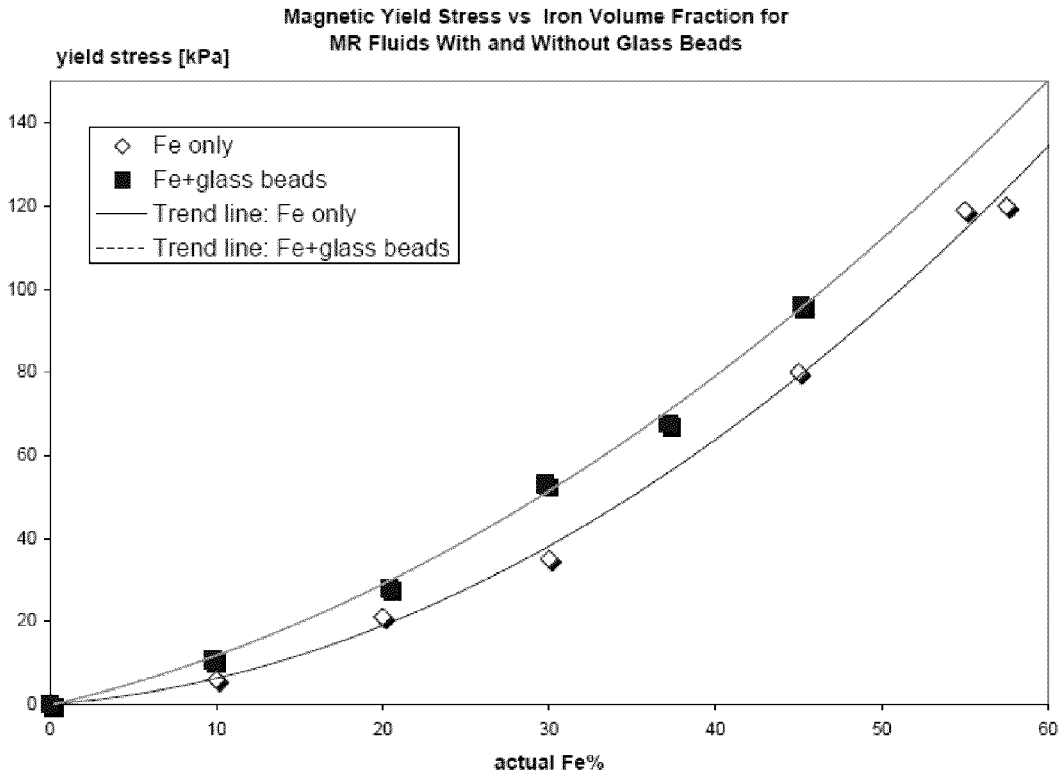
FIG. 1 is a graphical illustration of a relationship between on-state yield stress and iron volume fraction for magnetorheological compositions both including and substantially free of nonmagnetic material.

The present invention includes a magnetorheological composition. As used herein, the terminology "magnetorheological" refers to a material, substance, composition, or element whose rheological properties may be modified by a magnetic field. The magnetorheological composition may be useful for automotive applications, such as, but not limited to, fan clutches, transmission clutches, actuators, power steering pumps, semi-active suspension systems, and tunable-response systems. However, it is to be appreciated that the magnetorheological composition may also be useful for non-automotive applications, such as, but not limited to, body armor, energy absorption, and optics in the defense, construction, aerospace, and medical industries.

The magnetorheological composition includes a mixture of a carrier medium and a particle component disposed in the carrier medium. That is, the carrier medium may contain the particle component. The carrier medium may be any suitable carrier medium known in the art. For example, the carrier medium may be selected from the group of water, mineral oils, synthetic oils, hydrocarbons, silicone oils, elastomers, fats, gels, greases, esters, polyethers, fluorinated polyethers, polyglycols, fluorinated hydrocarbons, halogenated hydrocarbons, fluorinated silicones, organically modified silicones, and copolymers and/or combinations thereof. The carrier medium may be present in the magnetorheological composition in an amount of from about 20 to about 80 parts by volume based on 100 parts by volume of the magnetorheological composition.

The carrier medium may be, for example, a synthetic oil, such as a polyalphaolefin. The polyalphaolefin may have a kinematic viscosity of from 1.65 to 1.70 cSt at 100° C. and a total acid number of less than or equal to 0.05 mgKOH/g. A specific example of a suitable carrier medium for the purposes of the present invention is Spectrasyn™ 2, which is commercially available from ExxonMobil Chemical Corporation of Houston, Tex.

The particle component is disposed in the carrier medium. That is, the particle component may be substantially homogeneously dispersed in the carrier medium. As used herein, the terminology "substantially" and/or "about" is used to represent the inherent degree of uncertainty that may be attributed to any quantitative comparison, value, measurement, or other representation. As such, the terminology refers to an arrangement of elements or features that, while in theory would be expected to exhibit exact correspondence or behavior, may in practice embody something slightly less than exact. The terminology also represents the degree by which a quantitative representation may vary from a stated reference without resulting in a change in the basic function of the subject matter at issue. Therefore, it is contemplated that the particle component may be slightly less than homogeneously dispersed in the carrier medium. Alternatively, the particle component may be aligned within the carrier medium, for example, when exposed to a magnetic field, as set forth in more detail below.

Further, the mixture of the carrier medium and the particle component may be formed via any suitable method in the art. For example, the mixture may be formed by adding the particle component to the carrier medium or by adding the carrier medium to the particle component.

The particle component includes a magnetic material and a nonmagnetic material. The magnetic material may be any suitable magnetic material known in the art. For example, the magnetic material may be a metal selected from the group of iron; cobalt; nickel; and alloys thereof, such as iron-cobalt, iron-nickel, magnetic steel, iron-silicon; magnetic oxide ceramics, such as cubic ferrites, perovskites, garnets, including one or more metals from the group of iron, cobalt, nickel, copper, zinc, titanium, cadmium, vanadium, tungsten, and magnesium; mixed ferrites; and combinations of the group.

The magnetic material may be of any shape. For example, the magnetic material may include a plurality of particles having a rod-like, spherical, cubic, flake, bead, and/or pellet shape. Further, the magnetic material may be a powder.

Additionally, the magnetic material may include a first component and a second component. For example, the first component may have an average particle size of from about 6 to about 15 μm. That is, the first component may include a plurality of particles having an average particle size of about 8 μm. Similarly, the second component may have an average particle size of from about 1 to about 5 μm. That is, the second component may include a plurality of particles having an average particle size of about 2 μm. Therefore, the first component may include particles having a larger average particle size as compared to the second component. The first component may be present in the magnetic material in an amount of from about 20 to about 99 parts by weight based on 100 parts by weight of the magnetic material. For example, the first component and the second component may be present in the magnetic material in a ratio of 1:1 by weight.

In another example, the magnetic material may include only the first component. That is, the first component may be present in the magnetic material in an amount of about 100 parts by weight based on 100 parts by weight of the magnetic material.

In yet another example, the magnetic material may include only the second component. That is, the second component may be present in the magnetic material in an amount of about 100 parts by weight based on 100 parts by weight of the magnetic material.

A specific example of a suitable magnetic component is carbonyl iron powder, which is commercially available from BASF Corporation of Florham Park, N.J. A specific example of a suitable first component is carbonyl iron powder, grade CM, which is also commercially available from BASF Corporation of Florham Park, N.J. Likewise, a specific example of a suitable second component is carbonyl iron powder, grade HS, which is also commercially available from BASF Corporation of Florham Park, New Jersey.

The nonmagnetic material may be any suitable nonmagnetic material known in the art. For example, the nonmagnetic material may be substantially free from iron, nickel, and/or cobalt. The nonmagnetic material may include a plurality of particles selected from the group of aluminum, sand, vitreous material, ceramics, and combinations thereof.

The nonmagnetic material may be of any shape. For example, the nonmagnetic material may include a plurality of particles having a rod-like, spherical, cubic, flake, bead, and/or pellet shape. In one example, the plurality of particles of the nonmagnetic material may be substantially spherical. That is, the nonmagnetic material may include beads. Further, the plurality of particles of the nonmagnetic material may be hollow or solid. Additionally, the plurality of particles of the nonmagnetic material may be coated. For example, the plurality of particles may be coated with a metal such as, but not limited to, aluminum, or a coating, such as, but not limited to, a polymer. Further, the nonmagnetic material may be a powder. The plurality of particles of the nonmagnetic material may have an average particle size of from about 0.001 to about 100 ®m. For example, the particles of the nonmagnetic material may have an average particle size of from about 5 to about 50, more preferably about 9 to about 20 μm. Without intending to be limited by theory, nonmagnetic materials having an average particle size of from about 9 to about 13 μm, e.g., about 11 μm, may contribute to an excellent on-state yield stress at magnetic saturation, hereinafter "on-state yield stress" or "on-state yield stress at magnetic saturation", of the magnetorheological compositions. That is, magnetorheological compositions including the nonmagnetic material having an average particle size of from about 9 to about 13 μm may have a higher on-state yield stress than a magnetorheological composition that does not include the nonmagnetic material, or a magnetorheological composition that includes the nonmagnetic material having an average particle size of less than about 5 μm, as set forth in more detail below. Further, for a given magnetic material concentration, the on-state yield stress of the magnetorheological composition may be substantially independent of the type of nonmagnetic material included in the magnetorheological composition.

Specific examples of suitable nonmagnetic material include, but are not limited to, American Elements®AL-M-021-P 10 μm aluminum powder commercially available from Merelex Corporation of Los Angeles, Calif.; 11 or 12 μm aluminum-coated hollow microspheres, commercially available from Accumet Materials Company of Ossining, N.Y.; MIN-U-SIL® 15 fine ground silica, commercially available from U.S. Silica Company of Berkeley Springs, W.V.; SPHERICEL® 110P8 fused borosilicate glass, hollow nonporous microspheres, commercially available from Potters Industries, Inc. of Valley Forge, Pa.; Spheriglass® A-Glass 5000, 11-micron nominal diameter, also commercially available from Potters Industries, Inc. of Valley Forge, Pa.; SPHERICEL® 60P18 fused borosilicate glass, hollow nonporous microspheres, also commercially available from Potters Industries, Inc. of Valley Forge, Pa.; Prizmalite® P201 SL solid glass microspheres, 4-5 ®m, commercially available from Prizmalite Industries, Inc. of New York, N.Y., and Prizmalite® P2453BTA aluminum-coated glass beads, 50 μm nominal diameter, also commercially available from Prizmalite Industries, Inc. of New York, N.Y.; and combinations thereof.

The nonmagnetic material is present in the particle component in an amount of from about 5 to about 95 parts by volume based on 100 parts by volume of the particle component. For example, the nonmagnetic material may be present in the particle component in an amount of from about 10 to about 80 parts by volume based on 100 parts by volume of the particle component.

Further, the particle component is present in the magnetorheological composition in an amount of from about 20 to about 80 parts by volume based on 100 parts by volume of the magnetorheological composition. For example, the particle component may be present in the magnetorheological composition in an amount of from about 30 to about 70, more preferably 40 to 60 parts by volume based on 100 parts by volume of the magnetorheological composition.

Unexpectedly, the magnetorheological composition has an on-state yield stress at magnetic saturation of from about 0.1 to about 100 kPA. It is to be appreciated that the on-state yield stress at magnetic saturation generally increases with increasing magnetic material concentration. For example, referring to FIG. 1, for a magnetic material concentration of about 10 parts by volume based on 100 parts by volume of the magnetorheological composition, the magnetorheological composition may have an on-state yield stress of about 10 kPa, whereas a magnetorheological material having a magnetic material concentration of about 45 parts by volume based on 100 parts by volume of the magnetorheological composition may have an on-state yield stress of about 80 kPa or greater. Further, the magnetorheological composition may have an on-state yield stress at magnetic saturation over a magnetic material concentration range of from about 5 to about 60 parts by volume based on 100 parts by volume of the magnetorheological composition that is increased by from about 10 to about 90 percent as compared to an existing magnetorheological composition that is substantially free from the nonmagnetic material. On average, the on-state yield stress at magnetic saturation over a magnetic material concentration range of from about 5 to about 60 parts by volume based on 100 parts by volume of the magnetorheological composition is increased by about 32% as compared to existing magnetorheological compositions. Therefore, the magnetorheological composition exhibits excellent on-state yield stress at magnetic saturation as compared to existing magnetorheological compositions. As such, the magnetorheological composition enables the development of magnetorheological devices having higher force capability for a given size, or an equivalent force capability for a smaller size, as compared to available magnetorheological devices.

Further, the magnetorheological composition may have a density of less than 5 g/cm$^3$. That is, the magnetorheological composition may have a density over a magnetic material concentration range of from about 5 to about 60 parts by volume based on 100 parts by volume of the magnetorheological composition that is decreased by from about 5 to about 30 percent as compared to an existing magnetorheological composition that is substantially free from the nonmagnetic material. On average, the density at a magnetic material concentration over a range of from about 5 to about 60 parts by volume based on 100 parts by volume of the magnetorheological composition is decreased by from about 8 to about 20% as compared to existing magnetorheological compositions. Since the magnetorheological composition includes a lower concentration of magnetic material, the magnetorheological composition has a lower weight and density as compared to existing magnetorheological compositions. As such, the magnetorheological composition is cost effective.

Additionally, the magnetorheological composition may also include other components, such as, but not limited to additives and colorants. However, it is to be appreciated that the magnetorheological composition may be substantially free from a suspending agent. For example, the magnetorheological composition may be substantially free from fumed silica. Therefore, the magnetorheological composition suffers from less particle-carrier medium separation and less particle settling without the use of a suspending agent as compared to existing magnetorheological compositions.

It is also to be appreciated that the magnetorheological composition may differ from a ferrofluid. That is, as used herein, a ferrofluid refers to a mixture of magnetizable nanoparticles in a liquid suspension which does not, alone, behave as a magnetorheological fluid.

When the magnetorheological composition is subjected to a magnetic field, i.e., when "on-state", the viscosity of the magnetorheological composition generally increases substantially so that the magnetorheological composition may behave as a solid rather than a fluid. That is, when not subjected to the magnetic field, i.e., when "off-state", the particle component may be distributed substantially homogeneously in the carrier medium. In contrast, when subjected to the magnetic field, i.e., when "on-state", the particle component may align in chain-like structures disposed parallel to the magnetic field and perpendicular to the direction of flow. Therefore, flow may be impeded so that the magnetorheological composition behaves as a solid.

Further, without intending to be limited by theory, the comparatively larger average particle size of the first component of the magnetic material may help to hinder magnetic material migration and/or alter a length of the chain-like structures formed when the magnetorheological composition is subjected to the magnetic field. As such, for a given magnetic material concentration, the magnetorheological composition including the first component in a comparatively larger volume percent than the second component may have a higher on-state yield stress as compared to the magnetorheological composition including the second component in a comparatively larger volume percent than the first component. Stated differently, for a given magnetic material concentration, the magnetorheological composition including only the first component of the magnetic material may have an increased on-state yield stress as compared to the magnetorheological composition including only the second component of the magnetic material, and as compared to the magnetorheological composition including the first component and the second component in the magnetic material in a ratio of 1:1 by weight.

For example, for the magnetorheological composition including the magnetic material in an amount of about 30 parts by volume based on 100 parts by volume of the magnetorheological composition, the magnetorheological composition including only the first component of the magnetic material may have an on-state yield stress of from about 60 to about 70 kPa. In contrast, for the magnetorheological composition including the magnetic material in an amount of about 30 parts by volume based on 100 parts by volume of the magnetorheological composition, the magnetorheological composition including the first component and the second component in the magnetic material in a ratio of 1:1 by weight may have an on-state yield stress of from about 50 to about 60 kPa. Similarly, for the magnetorheological composition including the magnetic material in an amount of about 30 parts by volume based on 100 parts by volume of the magnetorheological composition, the magnetorheological composition including only the second component of the magnetic material may have an on-state yield stress of from about 40 to about 50 kPa.

In another embodiment, a magnetorheological composition includes a mixture of the polyalphaolefin and the particle component disposed in the polyalphaolefin. The particle component includes carbonyl iron powder and the nonmagnetic material, wherein the nonmagnetic material is present in the particle component in an amount of from about 7 to about 45 parts by volume, e.g., about 15 parts by volume, based on 100 parts by volume of the particle component. The particle component is present in the magnetorheological composition in an amount of about 45 parts by volume based on 100 parts by volume of the magnetorheological composition. The magnetorheological composition has an on-state yield stress at magnetic saturation of from about 0.1 to about 100 kPa.

In this embodiment, the carbonyl iron powder may include the first component having an average particle size of greater than about 6 μm. Further, the first component may be present in the carbonyl iron powder in an amount of from about 60 to about 99 parts by weight based on 100 parts by weight of the carbonyl iron powder.

Without intending to be limited to by theory, the nonmagnetic material may also help to hinder magnetic material, e.g., carbonyl iron powder, migration and/or alter a length of the chain-like structures formed when the magnetorheological composition is subjected to the magnetic field. As such, for a given carbonyl iron powder, i.e., magnetic material, concentration, the magnetorheological composition including the nonmagnetic material may have a higher on-state yield stress as compared to the magnetorheological composition including only the magnetic material.

For example, for the magnetorheological composition that is substantially free of the nonmagnetic material and includes carbonyl iron powder in an amount of about 30 parts by volume based on 100 parts by volume of the magnetorheological composition, wherein the first component and the second component are present in the magnetic material in a ratio of 1:1 by weight, the magnetorheological composition may have an on-state yield stress of about 40 kPa. In contrast, for the magnetorheological composition including both the carbonyl iron powder and the nonmagnetic material, the magnetorheological composition may have an on-state yield stress of greater than about 40 kPa. More specifically, and as set forth in more detail below, for the magnetorheological composition including carbonyl iron powder in an amount of about 30 parts by volume, and 11-micron average nominal diameter glass beads in an amount of about 15 parts by volume based on 100 parts by volume of the magnetorheological composition, the magnetorheological composition may have an on-state yield stress of from greater than about 40 kPa to about 100 kPa.

Moreover, without intending to be limited by theory, the aforementioned on-state yield stress enhancement provided by the nonmagnetic material may be a function of the particle size of the magnetic material, e.g., the carbonyl iron powder. Stated differently, for a magnetorheological composition including both the nonmagnetic material and the carbonyl iron powder, for a given carbonyl iron powder concentration, the magnetorheological composition including only the first component of the magnetic material may have an increased on-state yield stress as compared to the magnetorheological composition including only the second component of the magnetic material. Likewise, for a magnetorheological composition including both the nonmagnetic material and the carbonyl iron powder, for a given carbonyl iron powder concentration, the magnetorheological composition including only the first component of the magnetic material may have an increased on-state yield stress as compared to the magnetorheological composition including the first component and the second component in the magnetic material in a ratio of 1:1 by weight.

For example, as set forth above, for the magnetorheological composition that is substantially free of nonmagnetic material and includes carbonyl iron powder in an amount of about 30 parts by volume based on 100 parts by volume of the magnetorheological composition, wherein the first component and the second component are present in the magnetic material in a ratio of 1:1 by weight, the magnetorheological composition may have an on-state yield stress of about 40 kPa. In contrast, for the magnetorheological composition including carbonyl iron powder in an amount of about 30 parts by volume, and 11-micron nominal diameter glass beads in an amount of about 15 parts by volume based on 100 parts by volume of the magnetorheological composition, the magnetorheological composition including only the first component of the carbonyl iron powder may have an on-state yield stress of from about 60 to about 70 kPa. And, for the magnetorheological composition including carbonyl iron powder in an amount of about 30 parts by volume, and 11-micron nominal diameter glass beads in an amount of about 15 parts by volume based on 100 parts by volume of the magnetorheological composition, the magnetorheological composition including the first component and the second component in the carbonyl iron powder in a ratio of 1:1 by weight may have an on-state yield stress of from about 50 to about 60 kPa. Similarly, for the magnetorheological composition including carbonyl iron powder in an amount of about 30 parts by volume, and 11-micron nominal diameter glass beads in an amount of about 15 parts by volume based on 100 parts by volume of the magnetorheological composition, the magnetorheological composition including only the second component of the carbonyl iron powder may have an on-state yield stress of from about 40 to about 50 kPa.

In a further embodiment, a magnetorheological composition includes a mixture of the polyalphaolefin and the particle component disposed in the polyalphaolefin. The particle component includes the carbonyl iron powder and a nonmagnetic material having an average particle size of from about 9 to about 13 μm. For example, the nonmagnetic material may have an average particle size of about 11 μm. Without intending to be limited by theory, the nonmagnetic material having an average particle size of about 11 μm may help to hinder magnetic material migration and/or alter a length of the chain-like structures formed when the magnetorheological composition is subjected to the magnetic field. The nonmagnetic material is present in the particle component in an amount of from about 7 to about 45 parts by volume based on 100 parts by volume of the particle component. Further, the particle component is present in the magnetorheological composition in an amount of about 45 parts by volume based on 100 parts by volume of the magnetorheological composition. The magnetorheological composition has an on-state yield stress at magnetic saturation of from about 0.1 to about 100 kPa.

The magnetorheological compositions exhibit excellent on-state yield stress at magnetic saturation. Further, the magnetorheological compositions include a lower concentration of magnetic material, and therefore have a lower weight and density, as compared to existing magnetorheological compositions. Also, the magnetorheological compositions suffer from less particle-carrier medium separation and less particle settling without the use of a suspending agent as compared to existing magnetorheological compositions. As such, the magnetorheological compositions of the present invention are cost effective. Additionally, the magnetorheological compositions enable the development of magnetorheological devices having higher force capability for a given size, or an equivalent force capability for a smaller size, as compared to available magnetorheological devices.

EXAMPLES

The following examples are intended to illustrate the invention and are not to be viewed in any way as limiting to the scope of the invention.

Several magnetorheological compositions are formed from the components of the formulations listed in Table 1. More specifically, several magnetorheological compositions are prepared to determine a range of increased on-state yield stress provided by the addition of a nonmagnetic material to a mixture of magnetic material and a carrier medium. In particular, a magnetorheological composition is formed for each of Examples 1-8 and Comparative Examples 1-7 by mixing the components listed in Table 1 with Carrier Medium A according to the following procedures.

To form the magnetorheological compositions of Comparative Examples 1-7, Magnetic Material B is slowly added to Carrier Medium A and mixed with a paddle mixer for from 20 to 30 minutes.

To form the magnetorheological compositions of Examples 1-8, Magnetic Material B is slowly added to Carrier Medium A and mixed with a paddle mixer for from 20 to 30 minutes. The resulting blend is stirred for at least an additional 60 minutes. Uncoated Glass C and Al-Coated Glass D are then added to the blend and mixed with the paddle mixer until the resulting mixture is smooth. Immediately prior to use, the mixture is high-shear mixed for 3 minutes at 5,000 rpm using a Cowles blade in a 1-L glass jar. Notably, the magnetorheological compositions of Examples 1-8 are formulated to be substantially free from fumed silica.

TABLE 1

Magnetorheological Composition Formulations

| | Total Particle Component (vol %) | | Magnetic Material B (vol %) | | Uncoated Glass C (vol %) | | Al-Coated Glass D (vol %) | | Glass (C and/or D) (vol %)/Particle Component (vol %) | |
|---|---|---|---|---|---|---|---|---|---|---|
| Sample | Nom. | Act. | Nom. | Act. | Nom. | Act. | Nom. | Act. | Nom. | Act. |
| Magnetic Material-Only Formulations | | | | | | | | | | |
| Comp. Ex. 1 | 30 | 28.2 | 30 | 28.2 | — | — | — | — | — | — |
| Comp. Ex. 2 | 20 | 20.3 | 20 | 20.3 | — | — | — | — | — | — |
| Comp. Ex. 3 | 45 | 44.2 | 45 | 44.2 | — | — | — | — | — | — |
| Comp. Ex. 4 | 40 | — | 40 | — | — | — | — | — | — | — |
| Comp. Ex. 5 | 50 | 50.0 | 50 | 50.0 | — | — | — | — | — | — |
| Comp. Ex. 6 | 55 | 54.5 | 55 | 54.5 | — | — | — | — | — | — |
| Comp. Ex. 7 | 57.5 | 57.3 | 57.5 | 57.3 | — | — | — | — | — | — |
| Magnetic Material + Nonmagnetic Material Formulations | | | | | | | | | | |
| Ex. 1 | 45 | 44.96 | 30 | 29.76 | 15 | 15.19 | 0 | 0 | 0.333 | 0.338 |
| Ex. 2 | 45 | 46.43 | 30 | 29.75 | 0 | 0 | 15 | 16.68 | 0.333 | 0.359 |
| Ex. 3 | 45 | 45.90 | 20 | 20.40 | 25 | 25.50 | 0 | 0 | 0.556 | 0.555 |
| Ex. 4 | 45 | 47.27 | 37.5 | 37.19 | 7.5 | 10.08 | 0 | 0 | 0.167 | 0.213 |
| Ex. 5 | 45 | 43.63 | 10 | 9.81 | 35 | 33.82 | 0 | 0 | 0.778 | 0.775 |
| Ex. 6 | 45 | 46.19 | 0 | 0 | 0 | 0 | 45 | 46.19 | 1.000 | 1.000 |
| Ex. 7 | 45 | 46.17 | 0 | 0 | 45 | 46.17 | 0 | 0 | 1.000 | 1.000 |
| Ex. 8 | 52.75 | 52.08 | 45 | 45.13 | 7.75 | 6.94 | 0 | 0 | 0.147 | 0.133 |

Carrier Medium A is a polyalphaolefin having a kinematic viscosity of 1.7 cSt at 100° C. and 1,263 cSt at −54° C., which is commercially available under the trade name Spectrasyn™ 2 from ExxonMobil Chemical Corporation of Houston, Tex. Examples 1-8 are formulated to be substantially free from fumed silica.

Magnetic Material B is a mixture of carbonyl iron powder, grade CM, having an average particle size of 8 μm, and carbonyl iron powder, grade HS, having an average particle size of 2 μm, both commercially available from BASF Corporation of Florham Park, New Jersey. The mixture includes the grade CM and the grade HS carbonyl iron powder in a ratio of 1:1 by weight.

Uncoated Glass C is a plurality of hollow glass microspheres having an average particle size of 12 μm, commercially available from Accumet Materials Company of Ossining, N.Y.

Al-Coated Glass D is a plurality of aluminum-coated hollow microspheres having an average particle size of 12 μm, commercially available from Accumet Materials Company of Ossining, N.Y.

Each of the resulting magnetorheological compositions of Examples 1-8 and Comparative Examples 1-7 is characterized by measurement of off-state viscosity, off-state yield stress, bulk density, and on-state yield stress at magnetic saturation. The off-state viscosity, off-state yield stress, and on-state yield stress at magnetic saturation of each sample is measured by an Anton Paar USA commercial parallel plate magnetic rheometer, including a model MCR 501 base unit and a MRD 180/1T magnetorheological lower fixture, PP20-MRP upper rotating parallel plate fixture, and a PS-DC/MR2 power supply. The PP20-MRF gap surface is formed from a non-magnetizable stainless steel. The bulk density of each sample is measured using a Micrometrics AccuPyc 1330 Gas Displacement Pycnometer at 25° C. The samples are contained in a 10 cc aluminum cell, and high-purity helium is used as the displacement gas. A summary of the measurements is provided in Table 2.

Further, several calculated values are also provided in Table 2, such as equivalent iron volume fraction ($F_{eq}$), a theoretical density (ρ) of the magnetorheological compositions of Comparative Examples 1-7 at the equivalent iron volume fraction, and a ratio of the density ($\rho_{rel}$) of the magnetorheological compositions of Examples 1-8 to the density of the magnetorheological compositions of Comparative Examples 1-7 at the equivalent iron volume fraction. The equivalent iron volume fraction, $F_{eq}$, is defined as the magnetic material-only volume fraction required to achieve the same on-state yield stress at magnetic saturation as that observed for a given magnetic material-nonmagnetic material mixture. A summary of the nomenclature of Table 2 is summarized after Table 2.

TABLE 2

Magnetorheological Composition Properties

| Sample | $\tau_{sat}$ (kPa) | $Fe_{eq}$ | $\tau_{sp}$ (kPa/(g/cm$^3$)) | ρ (g/cm$^3$) Nom. | ρ (g/cm$^3$) Act. | ρ (g/cm$^3$) @$Fee_q$ | $\rho_{rel}$ | $N_F$ @5A (N) | $\tau_o$ (Pa) | $\eta_o$ (cp) |
|---|---|---|---|---|---|---|---|---|---|---|
| **Magnetic Material-Only Formulations** | | | | | | | | | | |
| Comp. Ex. 1 | 35 | — | 12.07 | 2.9 | 2.90 | — | — | — | Diffuse | 67 |
| Comp. Ex. 2 | 21 | — | 9.50 | 2.21 | 2.40 | — | — | — | 475 | 188 |
| Comp. Ex. 3 | 80 | — | 20.30 | 3.94 | 3.90 | — | — | — | Diffuse | 595 |
| Comp. Ex. 4 | — | — | — | — | — | — | — | — | 321 | 263 |
| Comp. Ex. 5 | — | — | — | — | 4.20 | — | — | — | 75 | 354 |
| Comp. Ex. 6 | 119 | — | — | — | 2.58 | — | — | — | 142 | 414 |
| Comp. Ex. 7 | 120 | — | 25.00 | 4.8 | 4.71 | — | — | — | 270 | 345 |
| **Magnetic Material + Nonmagnetic Material Formulations** | | | | | | | | | | |
| Ex. 1 | 53 | 35.8 | 18.60 | 2.85 | 2.83 | 3.28 | 0.870 | 28.5 | 335 | 477 |
| Ex. 2 | 53 | 35.8 | 18.53 | 2.86 | 2.84 | 3.28 | 0.873 | 28.5 | 407 | 499 |
| Ex. 3 | 28 | 26 | 13.08 | 2.14 | 2.16 | 2.53 | 0.846 | 11.8 | 93 | 220 |
| Ex. 4 | 67.6 | 40.9 | 20.01 | 3.379 | 3.35 | 3.63 | 0.931 | 38 | 292 | 364 |
| Ex. 5 | 10.8 | 14.1 | 7.57 | 1.427 | 1.42 | 1.78 | 0.804 | 3.6 | 52 | 230 |
| Ex. 6 | 0.034 | 0 | 0.05 | 0.754 | 0.75 | — | — | 0 | 10 | 111 |
| Ex. 7 | 0.022 | 0 | 0.05 | 0.717 | 0.71 | — | — | 0 | 31 | 130 |
| Ex. 8 | 96 | 49.5 | 24.63 | 3.897 | 3.91 | 4.22 | 0.923 | — | — | — |

Nomenclature of Table 2:

$\tau_{sat}$ magnetic yield stress at saturation $Fe_{eq}$ iron volume fraction at the equivalent magnetic yield stress $\tau_{sp}$ specific magnetic yield stress: $\tau_{sat}/\rho$ ρ magnetorheological composition density when fluid $\rho_{rel}$ ratio of Fe + glass density to Fe-only density at the same $\tau_{sat}$ $N_F$ normal force measured in a rheometer at magnetic saturation $\tau_o$ off-state yield stress $\eta_o$ off-state viscosity Yield Stress Enhancement An enhancement in on-state yield stress for the magnetorheological compositions of Examples 1-8 is summarized in FIG. 1. More specifically, FIG. 1 is a graphical illustration of a relationship between on-state yield stress and iron volume fraction for magnetorheological compositions both including (Examples 1-8) and substantially free of (Comparative Examples 1-7) nonmagnetic material, i.e., hollow glass microspheres. Stated differently, FIG. 1 is a comparison of on-state yield stress for magnetorheological compositions both including and substantially free of nonmagnetic material. A comparison of the magnetorheological compositions of Examples 1-8, hereinafter "iron+glass" or "Fe+glass", and Comparative Examples 1-7, hereinafter "iron only" or "Fe only", is made on a basis of the actual iron volume fraction (% Fe), since the hollow glass microspheres show no magnetic activity. The magnitude of the enhancement in on-state yield stress varies over the range of about 90% enhancement at low % Fe to about 10% enhancement at high % Fe, with an average of about 32% enhancement.

Equivalent % Magnetic Material (% Fe)

The equivalent effective iron volume fraction of each of the iron-glass magnetorheological compositions of Examples 1-8 is estimated using the curves in FIG. 1 based on the measured on-state yield stress at magnetic saturation. Polynomial curves are fit to the data in FIG. 1 to provide Equations (1) and (2).

$$\tau_{Fe}=0.0324Fe^2+0.3001Fe \quad (1)$$

$$\tau_{Fe+glass}=0.0266Fe^2+0.9147Fe \quad (2)$$

where Fe represents the actual iron volume fraction in the magnetorheological composition. Therefore, at a given iron volume fraction in the iron-glass magnetorheological compositions of Examples 1-8, the on-state yield stress is estimated using Equation (2). The on-state yield stress is then substituted into Equation (1) to calculate the effective, or equivalent, iron-only volume fraction required to produce the same on-state yield stress. The result of this exercise is shown in FIG. 2.

Figure 2:
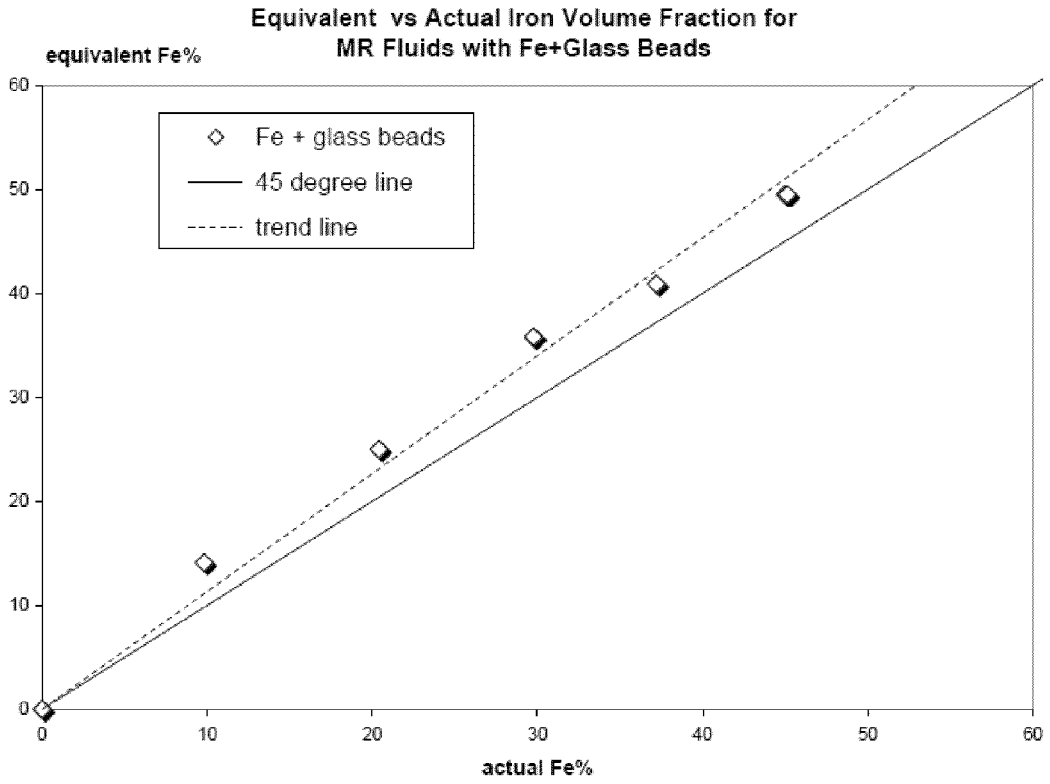
FIG. 2 is a graphical illustration of a relationship between equivalent and actual magnetic material volume fraction, Fe %, for magnetorheological compositions including magnetic material and nonmagnetic material.

FIG. 2 is a graphical illustration of a relationship between equivalent and actual magnetic material volume fraction, Fe %, for the magnetorheological compositions of Examples 1-8, including magnetic material and nonmagnetic material, hereinafter "Fe+glass beads". Stated differently, FIG. 2 is a comparison of the specific on-state yield stress at magnetic saturation for the magnetorheological compositions of Examples 1-8 to the magnetorheological compositions of Comparative Examples 1-7. The dashed curve in FIG. 2 shows the linear trend line for the calculated data compared against a 45° line for reference. The slope of the dashed line is about 1.13. Generally, on-state yield stress decreases linearly with increasing volume percent of nonmagnetic material content. Magnetorheological compositions including 45% nonmagnetic material generally have negligible on-state yield stress.

Cost and Density Improvements

The effective volume fraction of magnetic material can be used to estimate potential cost and weight savings of the magnetorheological compositions of Examples 1-8 as compared to the magnetorheological compositions of Comparative Examples 1-7. Costs for each magnetorheological composition can be compared by determining the mass of magnetic material and nonmagnetic material required to prepare magnetorheological compositions with equivalent on-state yields stresses, based on density and cost values for the magnetorheological compositions. The results of the calculations are summarized in FIG. 3.

Figure 3:
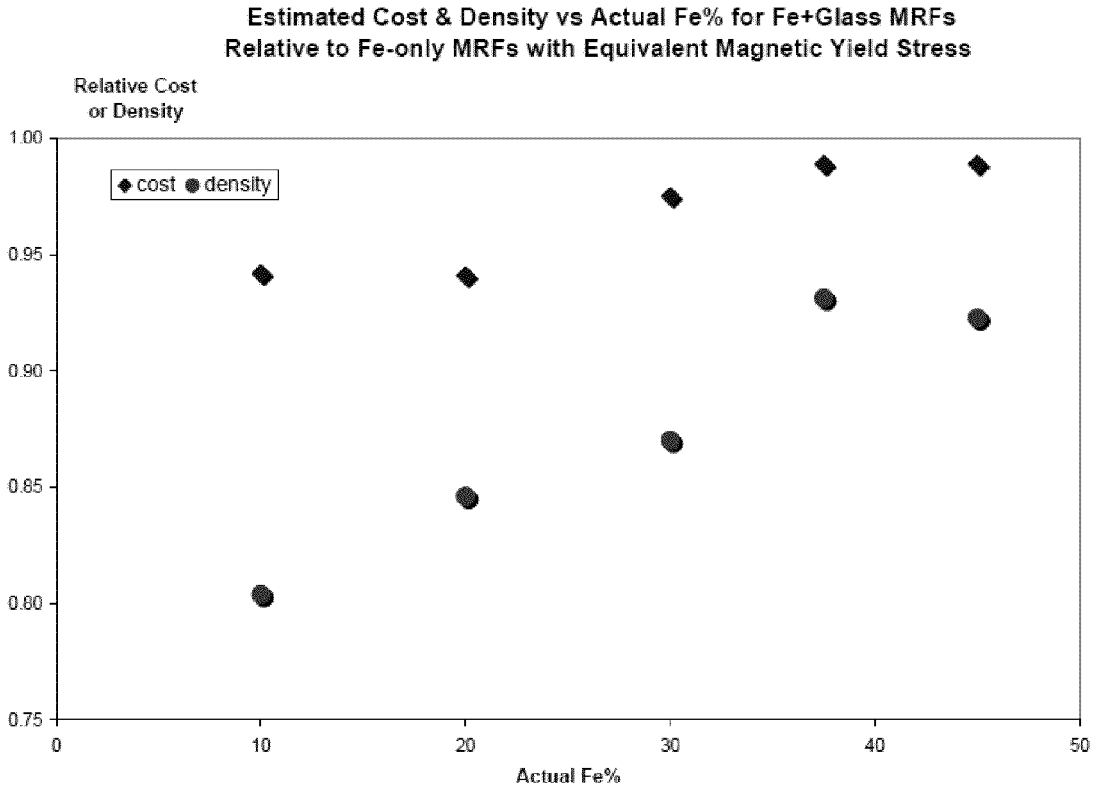
FIG. 3 is a graphical illustration of a relationship between relative cost or density and actual magnetic material volume percent for magnetorheological compositions including magnetic material and nonmagnetic material.

FIG. 3 is a graphical illustration of a relationship between relative cost or density and actual magnetic material volume percent for Examples 1, 3, 4, 5, and 8. Stated differently, FIG. 3 illustrates cost and density reduction estimates for magnetorheological compositions including magnetic material and nonmagnetic material. As shown in FIG. 3, magnetorheological compositions of Examples 1, 3, 4, 5, and 8 offer a cost savings of from about 1 to about 6% and a weight savings of from about 5 to about 20% as compared to the magnetorheological compositions of the Comparative Examples that include only magnetic material. Further, larger cost savings are achieved in lower ranges of iron concentration.

Yield Stress Enhancements as a Function of Magnetic Material Average Particle Size Several magnetorheological compositions are formed from the components of the formulations listed in Table 3. More specifically, several magnetorheological compositions are prepared to determine a range of increased on-state yield stress provided by the addition of a nonmagnetic material to a mixture of magnetic material and a carrier medium. In particular, a magnetorheological composition is formed for each of Examples 9-11 and Comparative Example 8 by mixing the components and nominal quantities listed in Table 3 with Carrier Medium A according to the following procedures.

To form the magnetorheological composition of Comparative Example 8, Magnetic Material B is slowly added to Carrier Medium A and mixed with a paddle mixer for from 20 to 30 minutes.

To form the magnetorheological compositions of Examples 1-8, Magnetic Material B, E, or F is slowly added to Carrier Medium A and mixed with a paddle mixer for from 20 to 30 minutes. Each resulting blend is stirred for at least an additional 60 minutes. Glass G is then added to the blend and mixed with the paddle mixer until the resulting mixture is smooth. Immediately prior to use, the mixture is high-shear mixed for 3 minutes at 5,000 rpm using a Cowles blade in a 1-L glass jar. Notably, the magnetorheological compositions of Examples 9-11 are formulated to be substantially free from fumed silica.

TABLE 3

| Magnetorheological Composition Formulations | | | | | |
|---|---|---|---|---|---|
| Sample | Total Particle Component (vol %) | Magnetic Material B (vol %) | Magnetic Material E (vol %) | Magnetic Material F (vol %) | Glass G (vol %) |
| Magnetic Material-Only Formulation | | | | | |
| Comp. Ex. 8 | 30 | 30 | — | — | — |
| Magnetic Material + Nonmagnetic Material Formulations | | | | | |
| Ex. 9 | 45 | — | 30 | — | 15 |
| Ex. 10 | 45 | 30 | — | — | 15 |
| Ex. 11 | 45 | — | — | 30 | 15 |

Magnetic Material E is carbonyl iron powder, grade HS, which has an average particle size of 2 μm and is commercially available from BASF Corporation of Florham Park, New Jersey.

Magnetic Material F is carbonyl iron powder, grade CM, which has an average particle size of 8 μm and is commercially available from BASF Corporation of Florham Park, New Jersey.

Glass G is a plurality of hollow glass microspheres having an average particle size of 11 μm, commercially available under the trade name Spheriglass® A-Glass 5000 from Potters Industries, Inc. of Valley Forge, Pa.

Figure 4:
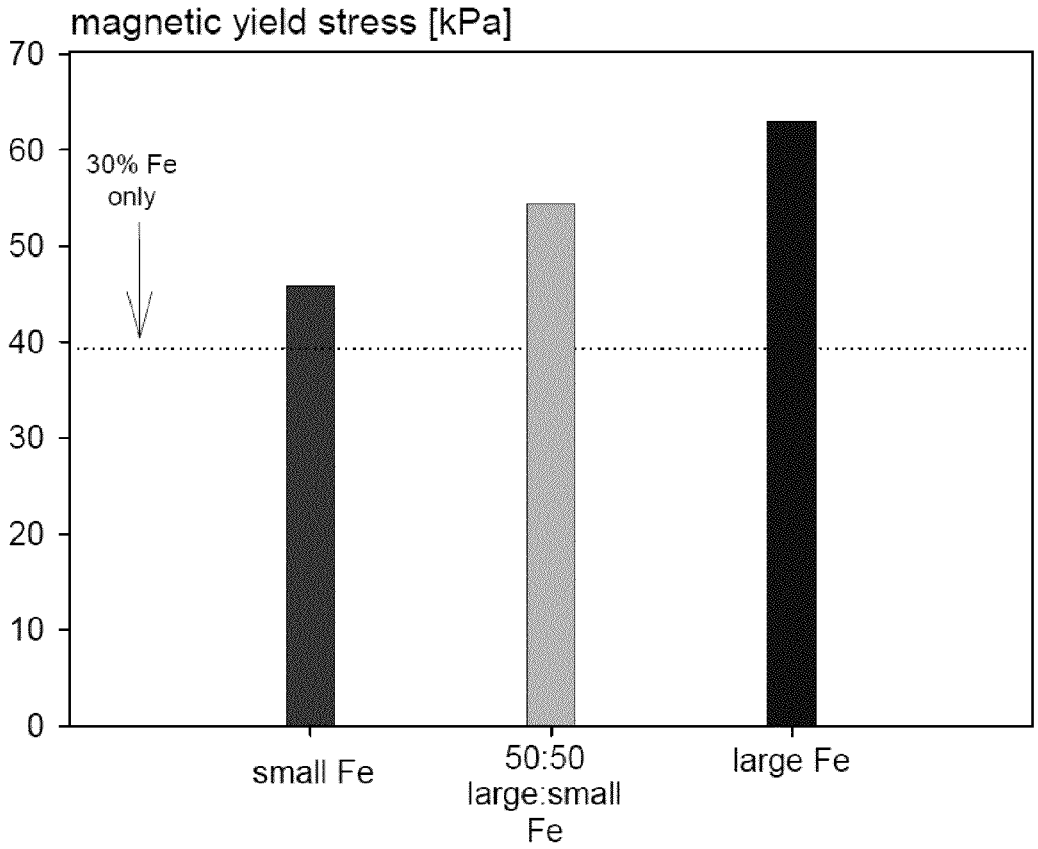
FIG. 4 is a graphical illustration of a relationship between on-state yield stress and magnetic material average particle size.

An enhancement in on-state yield stress for the magnetorheological compositions of Examples 9-11 as compared to the magnetorheological composition of Comparative Example 8 is summarized in FIG. 4. More specifically, FIG. 4 is a graphical illustration of a relationship between on-state yield stress and average magnetic material particle size for magnetorheological compositions both including (Examples 9-11) and substantially free of (Comparative Example 8) nonmagnetic material. FIG. 4 compares the magnetorheological compositions of Examples 9-11, which include various combinations of magnetic material having an average particle size of 2 μm, hereinafter "small Fe", and/or 8 μm, hereinafter "large Fe". Stated differently, FIG. 4 is a comparison of on-state yield stress for magnetorheological compositions including nonmagnetic material, and "small Fe" and/or "large Fe" magnetic material.

Referring to FIG. 4, the magnetorheological composition of Comparative Example 8 (represented by the dashed line labeled "30% Fe only"), which is substantially free of the nonmagnetic material, has a lower on-state yield stress as compared to the magnetorheological compositions of each of Examples 9-11, which each include 30 parts by volume of the magnetic material and 15 parts by volume of the nonmagnetic material based on 100 parts by volume of the magnetorheological compositions. Therefore, for a given magnetic material concentration, the magnetorheological compositions of Examples 9-11, which include the nonmagnetic material, have a higher on-state yield stress as compared to the magnetorheological composition of Comparative Example 8, which includes only the magnetic material.

Further, the magnetorheological composition of Example 10, which includes "small Fe" and "large Fe" in a ratio of 1:1 by weight has a higher on-state yield stress than the magnetorheological composition of Example 9, which includes only "small Fe". Likewise, the magnetorheological composition of Example 11, which includes only "large Fe" has a higher on-state yield stress than both of the magnetorheological compositions of Examples 9 and 10. Therefore, the aforementioned on-state yield stress enhancement provided by the nonmagnetic material is a function of the average particle size of the magnetic material. That is, as average particle size of the magnetic material increases, the on-state yield stress of the magnetorheological composition also increases.

Yield Stress Enhancement as a Function of Nonmagnetic Material Average Particle Size Several magnetorheological compositions are formed from the components of the formulations listed in Table 4. More specifically, several magnetorheological compositions are prepared to determine a range of increased on-state yield stress provided by the addition of a nonmagnetic material to a mixture of magnetic material and a carrier medium. In particular, a magnetorheological composition is formed for each of Examples 12-18 and Comparative Example 8 by mixing the components and nominal quantities listed in Table 4 with Carrier Medium A according to the following procedures.

To form the magnetorheological compositions of Examples 12-18, Magnetic Material B is slowly added to Carrier Medium A and mixed with a paddle mixer for from 20 to 30 minutes. Each resulting blend is stirred for at least an additional 60 minutes. Glass G, Glass H, Material J, Glass K, Glass M, or Glass N is then added to the blend and mixed with the paddle mixer until the resulting mixture is smooth. Immediately prior to use, the mixture is high-shear mixed for 3 minutes at 5,000 rpm using a Cowles blade in a 1-L glass jar. Notably, the magnetorheological compositions of Examples 12-18 are formulated to be substantially free from fumed silica.

TABLE 4

| Magnetorheological Composition Formulations | | | | | | | | | |
|---|---|---|---|---|---|---|---|---|---|
| Sample | Total Particle Component (vol %) | Magnetic Material B (vol %) | Glass C (vol %) | Glass G (vol %) | Glass H (vol %) | Mat. J (vol %) | Glass K (vol %) | Glass M (vol %) | Glass N (vol %) |
| Magnetic Material-Only Formulation | | | | | | | | | |
| Comp. Ex. 8 | 30 | 30 | — | — | — | — | — | — | — |
| Magnetic Material + Nonmagnetic Material Formulations | | | | | | | | | |
| Ex. 12 | 45 | 30 | 15 | — | — | — | — | — | — |
| Ex. 13 | 45 | 30 | — | 15 | — | — | — | — | — |
| Ex. 14 | 45 | 30 | — | — | 15 | — | — | — | — |
| Ex. 15 | 45 | 30 | — | — | — | 15 | — | — | — |
| Ex. 16 | 45 | 30 | — | — | — | — | 15 | — | — |
| Ex. 17 | 45 | 30 | — | — | — | — | — | 15 | — |
| Ex. 18 | 45 | 30 | — | — | — | — | — | — | 15 |

Glass H is a plurality of solid glass microspheres having an average particle size of 5 μm, commercially available under the trade name Prizmalite® P201 SL from Prizmalite Industries, Inc. of New York, N.Y.

Material J is nonmagnetic aluminum powder having an average particle size of 5 μm, commercially available under the trade name American Elements®AL-M-021-P from Merelex Corporation of Los Angeles, Calif.

Glass K is a plurality of solid glass microspheres having an average particle size of 11 μm, commercially available under the trade name Spheriglass® A-Glass 5000 from Potters Industries, Inc. of Valley Forge, Pa.

Glass M is a plurality of hollow glass microspheres having an average particle size of 18 μm, commercially available under the trade name Sphericel® from Potters Industries, Inc. of Valley Forge, Pa.

Glass N is a plurality of aluminum-coated solid glass beads having an average particle size of 50 μm, commercially available under the trade name Prizmalite® P2453BTA from Prizmalite Industries, Inc. of New York, N.Y.

Figure 5:
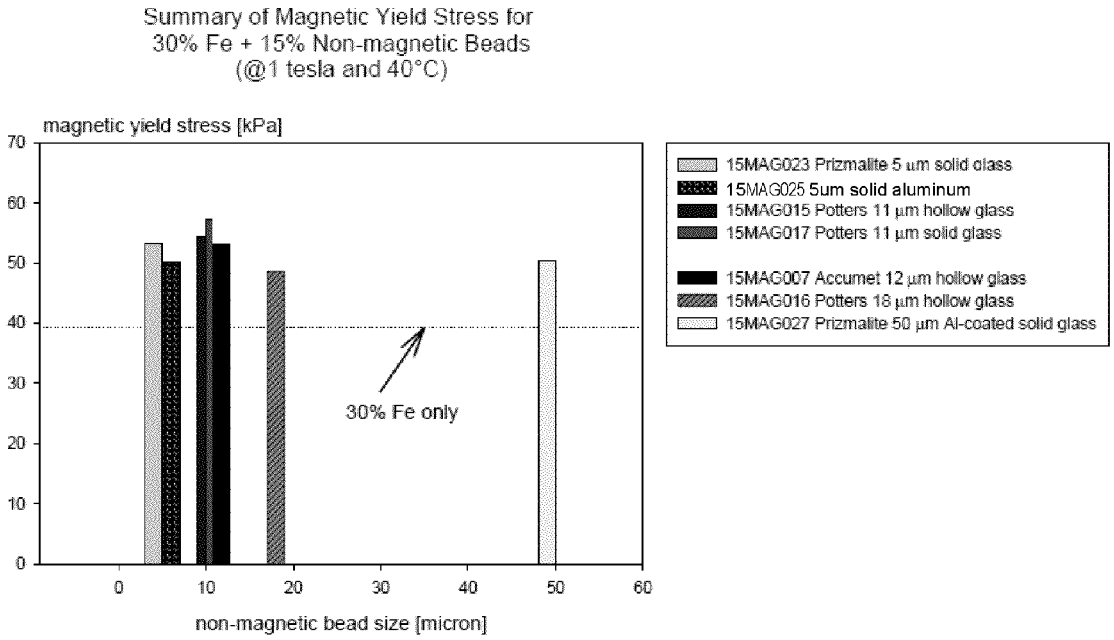
FIG. 5 is a graphical illustration of a relationship between on-state yield stress and nonmagnetic material average particle size.

An enhancement in on-state yield stress for the magnetorheological compositions of Examples 12-18 as compared to the magnetorheological composition of Comparative Example 8 is summarized in FIG. 5. More specifically, FIG. 5 is a graphical illustration of a relationship between on-state yield stress and nonmagnetic material particle size for magnetorheological compositions both including (Examples 12-18) and substantially free of (Comparative Example 8) nonmagnetic material. The magnetic material includes "large Fe" and "small Fe" in a ratio of 1:1 by weight.

Referring to FIG. 5, the magnetorheological composition of Comparative Example 8 (represented by the dashed line labeled "30% Fe only"), which is substantially free of the nonmagnetic material, has a lower on-state yield stress as compared to the magnetorheological compositions of each of Examples 12-18, which each include 30 parts by volume of magnetic material and 15 parts by volume of nonmagnetic material based on 100 parts by volume of the magnetorheological compositions. Therefore, for a given magnetic material concentration, the magnetorheological compositions of Examples 12-18 including the nonmagnetic material have a higher on-state yield stress as compared to the magnetorheological composition including only the magnetic material. Further, the magnetorheological composition of Examples 13 and 16, which include the nonmagnetic material having an average particle size of 11 μm, have a higher on-state yield stress than the magnetorheological compositions of the other examples. Therefore, a maximum on-state yield stress may occur for magnetorheological compositions including the nonmagnetic material having an average particle size of about 11 μm.

Yield Stress Enhancement as a Function of Nonmagnetic Material

Two additional magnetorheological compositions are formed from the components of the formulations listed in Table 5. More specifically, the two magnetorheological compositions are prepared to determine a range of increased on-state yield stress provided by the addition of a nonmagnetic material to a mixture of magnetic material and a carrier medium. In particular, a magnetorheological composition is formed for each of Examples 19 and 20 by mixing the components and nominal quantities listed in Table 5 with Carrier Medium A according to the following procedures.

To form the magnetorheological compositions of Examples 19-20, Magnetic Material B is slowly added to Carrier Medium A and mixed with a paddle mixer for from 20 to 30 minutes. The resulting blend is stirred for at least an additional 60 minutes. Al-Coated Glass P or Glass Q are then added to the blend and mixed with the paddle mixer until the resulting mixture is smooth. Immediately prior to use, the mixture is high-shear mixed for 3 minutes at 5,000 rpm using a Cowles blade in a 1-L glass jar.

TABLE 5

| Magnetorheological Composition Formulations | | | | |
|---|---|---|---|---|
| Sample | Total Particle Component (vol %) | Magnetic Material B (vol %) | Al-Coated Glass P (vol %) | Glass Q (vol %) |
| Magnetic Material-Only Formulation | | | | |
| Comp. Ex. 8 | 30 | 30 | — | — |
| Magnetic Material + Nonmagnetic Material Formulations | | | | |
| Ex. 19 | 45 | 30 | 15 | — |
| Ex. 20 | 45 | 30 | — | 15 |

Al-Coated Glass P is a plurality of aluminum-coated hollow microspheres having an average particle size of 11 μm, commercially available from Accumet Materials Company of Ossining, N.Y.

Glass Q is fine ground silica having an average particle size of 10 μm, commercially available under the trade name MIN-U-SIL® 15 from U.S. Silica Company of Berkeley Springs.

Figure 6:
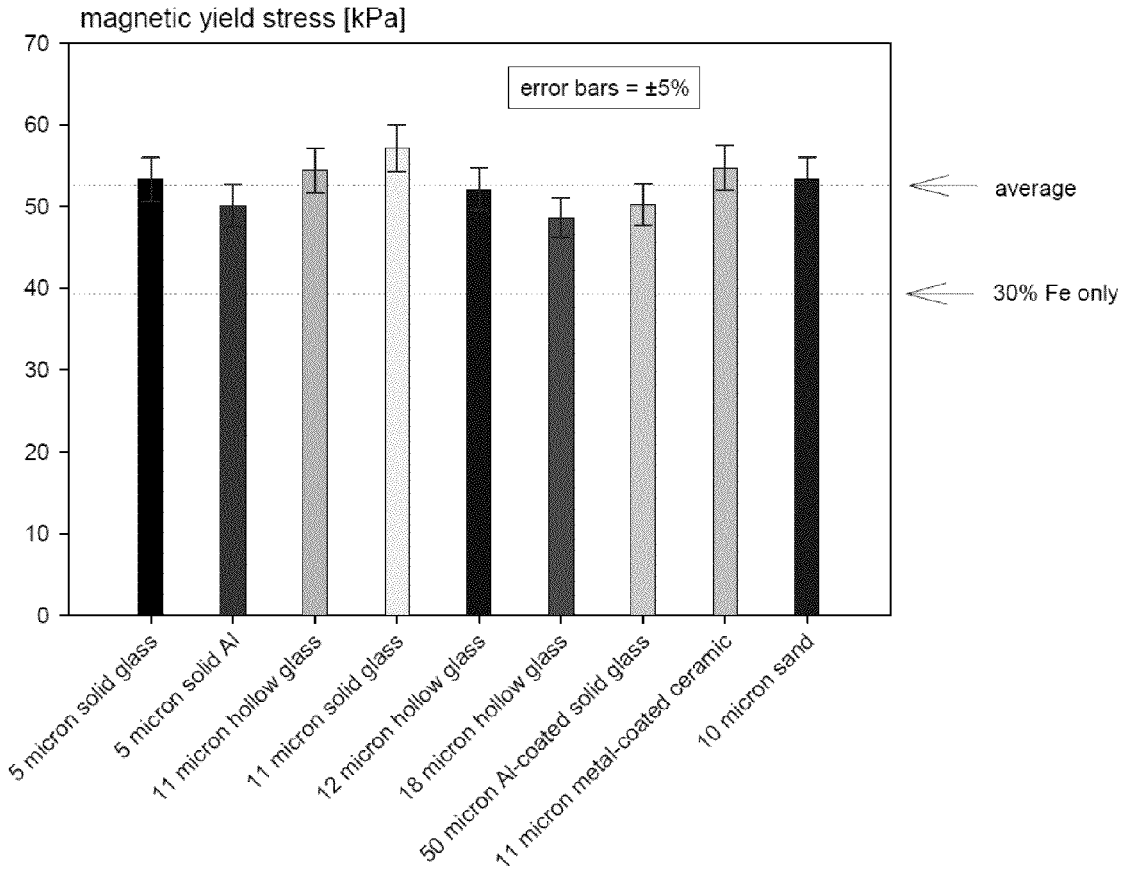
FIG. 6 is a graphical illustration of a relationship between on-state yield stress and type of nonmagnetic material.

An enhancement in on-state yield stress for the magnetorheological compositions of Examples 12-20 as compared to the magnetorheological composition of Comparative Example 8 (represented by the dashed line labeled "30% Fe only") is summarized in FIG. 6. More specifically, FIG. 6 is a graphical illustration of a relationship between on-state yield stress and type of nonmagnetic material (Examples 12-20) as compared to a magnetorheological material that is substantially free of nonmagnetic material (Comparative Example 8). The dashed line labeled "average" represents the average on-state yield stress of all of the magnetorheological compositions of Examples 12-20. Further, the error bars represent +/−5% of the value of the on-state yield stress for each of Examples 12-20, which is based on the repeatability of the on-state yield stress measurement methods set forth above.

Referring to FIG. 6, the magnetorheological composition of Comparative Example 8, which is substantially free of the nonmagnetic material, has a lower on-state yield stress as compared to the magnetorheological compositions of each of Examples 12-20, which include 30 parts by volume of magnetic material and 15 parts by volume of nonmagnetic material based on 100 parts by volume of the magnetorheological compositions. Therefore, for a given magnetic material concentration, the on-state yield stresses of the magnetorheological compositions of Examples 12-20 are substantially independent of the type of nonmagnetic material included in the magnetorheological compositions.

While the best modes for carrying out the invention have been described in detail, those familiar with the art to which this invention relates will recognize various alternative designs and embodiments for practicing the invention within the scope of the appended claims.

The invention claimed is:

1. A magnetorheological composition comprising a mixture of:

a carrier medium; and a particle component disposed in said carrier medium and including;

a magnetic material; and a nonmagnetic material including a plurality of particles selected from the group of aluminum, sand, vitreous material, ceramics, and combinations thereof, wherein said plurality of particles are hollow;

wherein said nonmagnetic material is present in said particle component in an amount of from about 5 to about 95 parts by volume based on 100 parts by volume of said particle component;

wherein said particle component is present in said magnetorheological composition in an amount of from about 20 to about 80 parts by volume based on 100 parts by volume of said magnetorheological composition;

wherein said magnetorheological composition has an on-state yield stress at magnetic saturation of from about 0.1 to about 100 kPa.

2. The magnetorheological composition of claim 1, wherein said magnetorheological composition has a density of less than 5 g/cm$^3$.

3. The magnetorheological composition of claim 1, wherein said magnetorheological composition has an on-state yield stress at magnetic saturation over a magnetic material concentration range of from about 5 to about 60 parts by volume based on 100 parts by volume of said magnetorheological composition that is increased by from about 10 to about 90 percent as compared to an existing magnetorheological composition that is substantially free from said nonmagnetic material.

4. The magnetorheological composition of claim 1, wherein said magnetorheological composition has a density over a magnetic material concentration range of from about 5 to about 60 parts by volume based on 100 parts by volume of said magnetorheological composition that is decreased by from about 5 to about 30 percent as compared to an existing magnetorheological composition that is substantially free from said nonmagnetic material.

5. The magnetorheological composition of claim 1, wherein said plurality of particles has an average particle size of from about 0.001 to about 100 μm.

6. The magnetorheological composition of claim 1, wherein said plurality of particles are substantially spherical.

7. The magnetorheological composition of claim 1, wherein said plurality of particles are coated.

8. The magnetorheological composition of claim 1, wherein said magnetic material includes a first component and a second component.

9. The magnetorheological composition of claim 8, wherein said first component is present in said magnetic material in an amount of from about 20 to about 99 parts by weight based on 100 parts by weight of said magnetic material.

10. The magnetorheological composition of claim 8, wherein said first component has an average particle size of from about 6 to about 15 μm.

11. The magnetorheological composition of claim 8, wherein said second component has an average particle size of from about 1 to about 5 μm.

12. The magnetorheological composition of claim 1, wherein said carrier medium is selected from the group of water, mineral oils, synthetic oils, hydrocarbons, silicone oils, elastomers, fats, gels, greases, esters, polyethers, fluorinated polyethers, polyglycols, fluorinated hydrocarbons, halogenated hydrocarbons, fluorinated silicones, organically modified silicones, and copolymers and/or combinations thereof.

13. The magnetorheological composition of claim 1, wherein said magnetorheological composition is substantially free from a suspending agent.

14. A magnetorheological composition comprising a mixture of:

a polyalphaolefin; and a particle component disposed in said polyalphaolefin and including;

carbonyl iron powder; and a nonmagnetic material including a plurality of particles selected from the group of aluminum, sand, vitreous material, ceramics, and combinations thereof, wherein said plurality of particles are hollow;

wherein said nonmagnetic material is present in said particle component in an amount of from about 7 to about 45 parts by volume based on 100 parts by volume of said particle component;

wherein said particle component is present in said magnetorheological composition in an amount of from about 40 to about 55 parts by volume based on 100 parts by volume of said magnetorheological composition;

wherein said magnetorheological composition has an on-state yield stress at magnetic saturation of from about 0.1 to about 100 kPa.

15. The magnetorheological composition of claim 14, wherein said carbonyl iron powder includes a first component having an average particle size of greater than about 6 μm.

16. The magnetorheological composition of claim 15, wherein said first component is present in said carbonyl iron powder in an amount of from about 60 to about 99 parts by weight based on 100 parts by weight of said carbonyl iron powder.

17. A magnetorheological composition comprising a mixture of:

a polyalphaolefin; and a particle component disposed in said polyalphaolefin and including;

carbonyl iron powder; and a nonmagnetic material having an average particle size of from about 9 to about 13 μm;

wherein said nonmagnetic material is present in said particle component in an amount of from about 7 to about 45 parts by volume based on 100 parts by volume of said particle component;

wherein said particle component is present in said magnetorheological composition in an amount of about 45 parts by volume based on 100 parts by volume of said magnetorheological composition;

wherein said magnetorheological composition has an on-state yield stress at magnetic saturation of from about 0.1 to about 100 kPa.

* * * * *